US007946736B1

(12) United States Patent
Horian

(10) Patent No.: US 7,946,736 B1
(45) Date of Patent: May 24, 2011

(54) COVER FOR RECESSED DOWN-LIGHT

(76) Inventor: Richard C. Horian, Corona, CA (US)

( * ) Notice: Subject to any disclaimer, the term of this patent is extended or adjusted under 35 U.S.C. 154(b) by 0 days.

(21) Appl. No.: 12/856,973

(22) Filed: Aug. 16, 2010

(51) Int. Cl.
*F21V 15/00* (2006.01)

(52) U.S. Cl. ..... 362/364; 362/268; 362/311.01; 362/311.14; 362/326; 362/362

(58) Field of Classification Search ..... 362/257, 362/268, 311.01, 311.14, 326, 362, 364
See application file for complete search history.

(56) References Cited

U.S. PATENT DOCUMENTS

| | | | | |
|---|---|---|---|---|
| D183,117 | S | 7/1958 | Coleman et al. | D48/16 |
| 3,543,224 | A | 11/1970 | Fisher | 339/125 |
| 4,099,224 | A | 7/1978 | Valpey | 362/433 |
| 5,128,850 | A | 7/1992 | Juodvalkis | 362/352 |
| D350,834 | S | 9/1994 | Roos et al. | D26/134 |
| 5,738,437 | A | 4/1998 | Ilagan | 362/363 |
| 5,820,247 | A | 10/1998 | Schuler | 362/96 |
| 6,231,214 | B1 | 5/2001 | Haugaard | 362/375 |
| 6,814,471 | B1 | 11/2004 | Stoner | 362/364 |
| 7,048,414 | B2 | 5/2006 | Weber | 362/267 |
| 7,168,825 | B2 * | 1/2007 | McArthur | 362/267 |
| 7,434,961 | B1 | 10/2008 | Bernhardt et al. | 362/255 |
| 7,748,869 | B2 | 7/2010 | Sevack et al. | 362/277 |

* cited by examiner

*Primary Examiner* — Stephen F Husar
*Assistant Examiner* — Meghan K Dunwiddie
(74) *Attorney, Agent, or Firm* — Connolly Bove Lodge & Hutz LLP

(57) ABSTRACT

A cover that may be attached directly to the ceiling around a recessed down-light fixture to change the appearance of the recessed light fixture to an external light fixture without losing access to the fixture. The cover includes a first lens with an outer dome, a flange lying in a plane extending from a first periphery of the first lens and a central circular hole through the outer dome. Notches are arranged about the periphery of the central circular hole. A second lens includes an cup which has a circular periphery with a diameter of noninterference fit with the central circular hole. Tabs extend radially outwardly from the circular periphery and are configured and arranged to fit through the notches.

7 Claims, 2 Drawing Sheets

COVER FOR RECESSED DOWN-LIGHT

BACKGROUND OF THE INVENTION

The field of art of the present invention is lens covers for light fixtures.

Recessed down-light fixtures built into the ceiling typically end flush with the horizontal plane of the ceiling with the mechanics of the fixture remaining above the plane of the ceiling and attached to joists, rafters or hangers. Such fixtures also typically have a rim running around the bottom of the fixture that does protrude slightly below the horizontal plane of the ceiling. However, these rims rarely protrude more than one-fourth of an inch beyond the horizontal plane of the ceiling. Further, such fixtures are conventionally built having a 4", 5" or 6" diameter with the interior of the fixture including a straight wall or cone shaped interior. Yet there is no absolute standard for a fixed internal or external size of these recessed lighting fixtures and often the shape, length, width and depth of the fixture can differ by inches. Such fixtures do not easily provide for a change in the appearance. Further, the light emitted by these fixtures is only changed by changing the bulb.

Recently a major development has taken place in electric light bulbs. The development of the CFL, compact fluorescent lamp, has changed the emitted light from and appearance of the recessed down-light fixtures. The CFL is a tremendous energy and money savings device. As a replacement for the average screw in light bulb, CFL bulbs are an excellent option. In simplest terms, CFLs are a miniature version of the common fluorescent light, using an electrical current to make phosphor gas glow. Older CFLs use magnetic ballasts which usually cause a delay and/or flicker when they are turned on. Most new CFLs use electronic ballasts that eliminate this. When compared to incandescent bulbs, CFLs are approximately four times as efficient; a 25 Watt CFL will have the same light output as a 100 Watt incandescent. They also last up to 10 times longer than incandescent bulbs. Unlike a regular fluorescent light, a CFL gives off light that approximates a standard incandescent. This rather awkward appearance of a CFL is not as attractive as the symmetrical incandescent bulb or even the 'spotlight' bulb. To remedy the appearance of the bulb, many manufacturers are now offering CFL's with attached semi-circular globes covering the spiral twisted tubes at a substantial additional cost.

CFL's are not the only new lamp design being used in recessed lighting fixtures. The even newer LED bulbs are gaining popularity in use and many use other types of bulbs. The fact remains that recessed lighting fixtures with their exposed glaring, harsh lights are unattractive to many that would prefer an alternative that would be more attractive and provide a more pleasing and more broadly distributed lighting ambiance.

It is not easy to change the appearance of recessed lighting fixtures. As previously noted, these fixtures are usually built into and attached above the ceiling; usually when the home was first built. The differences in the size and shape of these fixtures makes it very difficult to universally mount a light covering to the fixture that would hide and or change its appearance and function.

The possibility of hanging a fixture that would be attached to the light bulb within the fixture is equally daunting. First, anything physically attached to the light bulb should receive certification from UL (Underwriters Laboratories) for purposes of qualifying the attachment. The reason for this is that anything attached to the bulb itself is subject to both heat as well as electrical connection considerations. Further, the same problem exists that different bulb types have many different shapes and sizes making a universal mounting system difficult.

An effective method of covering the appearance of unattractive and or harsh direct lighting provided by recessed lighting fixtures and the unattractive and or harsh light from bare light bulbs used therein is advantageous providing the following criteria are met singularly and or in combination.

The Art Deco movement was an eclectic artistic and design style which had its origins in Paris in the first decades of the 20th century. Many beautiful designs for lighting fixtures were created during this period and still used today for their elegant sweeping lines. One such design used for lighting fixtures was the 'gentle dome'; a slightly concave, oversized dish that when used as a lighting cover, distributed light evenly over a broad range. This light cover design offered beauty and elegance with the additional feature of reducing glare emitted by the bare light bulb it was designed to cover.

SUMMARY OF THE INVENTION

The present invention is directed to a cover for a recessed down-light fixture. There are two lenses. The first has an outer dome with a central circular hole there through. This lens also has a flange lying in a plane extending from its periphery. The second lens has a cup having a circular periphery with attachment to the outer dome. This cover can attach below a down-light without interfering therewith to provide greater esthetics and to provide the option of diffusing or redirecting the light radiating from the fixture.

In a first separate aspect of the present invention, the hole in the first lens may have a diameter allowing manual access. This allows facile replacement of a bulb.

In a second separate aspect of the present invention, the attachment of the cup to the outer dome includes tabs extending radially outwardly from the circular periphery of the cup and notches about the periphery of the central circular hole. The tabs are configured and arranged to fit through the notches. This attachment can provide venting for the convection of air into the down-light fixture through the notches.

In supplemental aspects of the present invention, the periphery of the cup may have a diameter which has a non-interference fit with the central circular hole. A ring of adhesive material such as foam tape with double sided adhesive may extend about the flange on the first lens as a means for permanent attachment. The cup of the second lens may have a contour with a peripheral portion upstanding for manual purchase. This can assist in rotation of the second lens with the tabs extended through the notches. The upstanding peripheral portion can be cylindrical. Equiangular spacing of the tabs and notched can add to the esthetic appearance. Of course, any of these separate and supplemental aspects can be used with one another to greater advantage.

Accordingly, it is an object of the present invention to provide an esthetic and advantageous cover for a down-light fixture. Other and further objects and advantages will appear hereinafter.

DETAILED DESCRIPTION OF THE PREFERRED EMBODIMENTS

Figure 1:
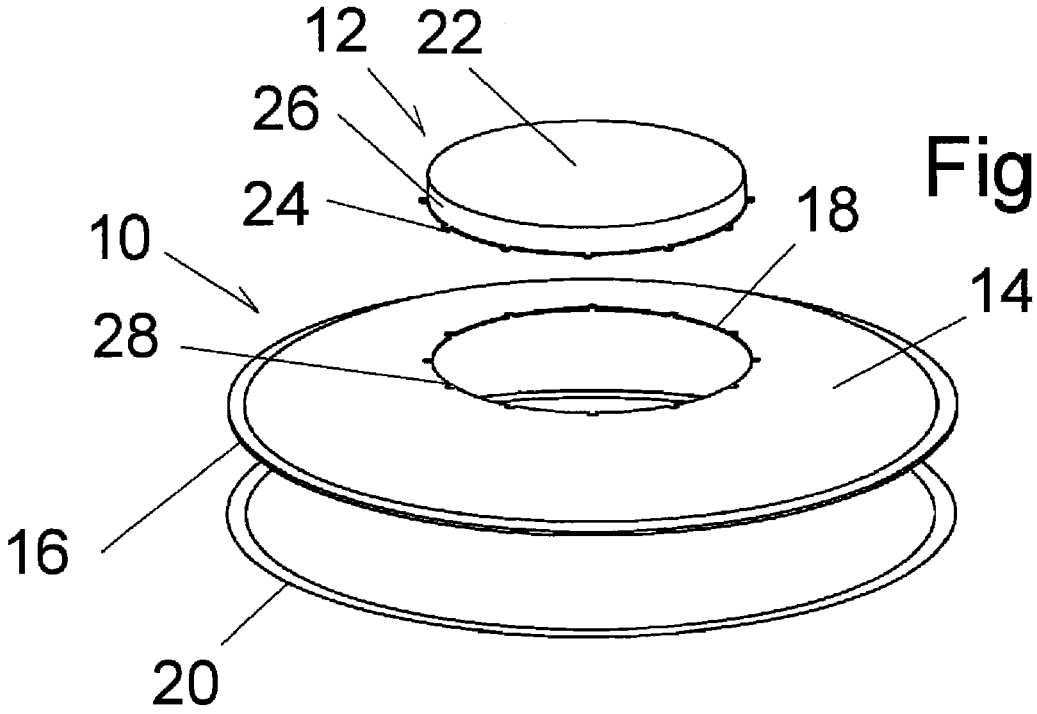
FIG. 1 is a perspective view of the convex side of a down-light cover in exploded assembly.
Figure 2:
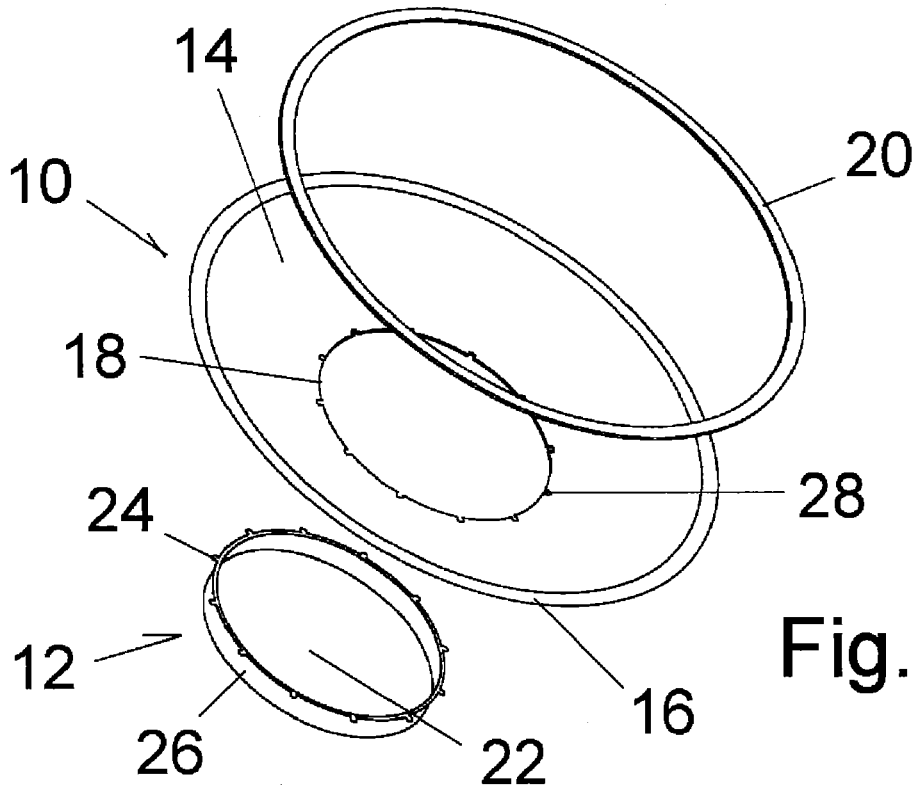
FIG. 2 is a perspective view of the convex side of a down-light cover in exploded assembly.
Figure 3:
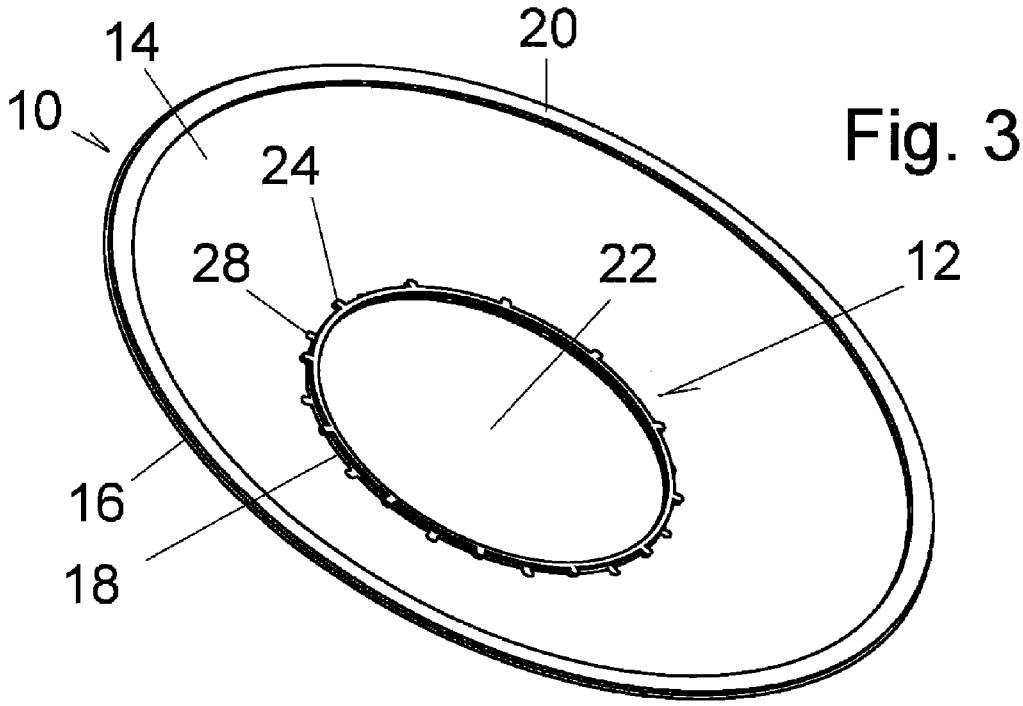
FIG. 3 is a perspective view of the concave side of an assembled down-light cover.
Figure 4:
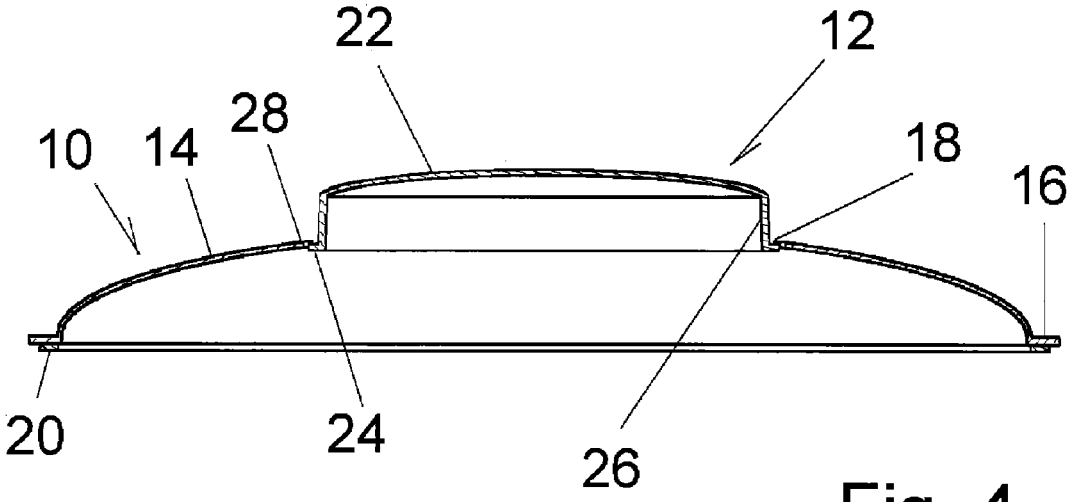
FIG. 4 is a cross-sectional side view of the an assembled down-light cover.

Several attributes are found in preferred embodiment of the Figures:

(1) The light covering covers the entire exposed recessed lighting fixture;

(2) The light covering fits over all commonly used recessed lighting fixtures;

(3) The light cover can be used with any type of light bulb including the newer CFL's;

(4) The light cover can be attached to the ceiling without interfering with the mechanics or electrical connections of the existing recessed light fixture;

(5) The light cover is easy to attach without the use of tools;

(6) The light cover allows access to the light bulb in the fixture to change the light bulb without tools.

The preferred embodiment of the cover for a down-light includes two lenses 10, 12. The first lens 10 includes an outer dome 14. This is a gently sloped dome 14 of the 'deco' design with an outer diameter of approximately 12" and a total inner concave depth of only one inch. Any shape, periphery or design for the dome 14 may be used that could be considered pleasing and or functional for a light cover. The outer dome 14 has a flange 16 lying in a plane and extending the full periphery of the outer dome 14. The flange is approximately one fourth inch. There is a central circular hole 18 in the center of the outer dome 14 that is approximately five inches in diameter or larger. Any size hole 18 may be used providing the diameter is greater than the anticipated bulb employed in the down-light fixture and the ability to manually reach and change it.

A ring of tape 20 with two sided adhesive is attached to the flange 16 on the concave side of the dome 14. Foam tape 20 is recommended to accommodate variations in the ceiling surrounding a down-light in place. Any adhesive material such as tape, caulk or adhesive compound may be used in sections or extending fully around the flange 20.

The second lens includes a separate cup 22. The cup 22 is approximately the same diameter as the hole 18 in the outer dome 14 but slightly less in overall size to create a noninterference fit. The cup 22 has tabs 24 protruding radially outwardly from the peripheral edge. The tabs 24 may be of any size or shape or number. A preferred embodiment would be to include twelve tabs that are equiangularly placed. The dimensions for each of the tabs 24 is approximately ⅛"×⅛" with rounded corners at the tip of each.

The cup 22 may be of any shape aesthetically pleasing to be mated with the outer dome 14. If the cup 22 has a loose fit with the outer dome 14, no manual purchase is required to manipulate the assembly. If the cup 22 is more snuggly assembled with the outer dome 14, the contour of the cup 22 may be advantaged by an upstanding peripheral portion 26 approaching a cylinder for manual purchase to rotate and extract the cup 22. The body of the cup within the cylindrical wall 26 may be domed as well.

The outer dome 14 has notches 28 about the inner periphery of the outer dome 14. The notches 28 are configured and arranged to receive the tabs 24 to define an attachment of the cup 22 to the outer dome 14. The notches 28 are advantageously slightly larger than the tabs 24 to facilely accept the tabs 24 as the cup 22 is positioned in the central circular hole 18 of the outer dome 14. The notches 28 are preferably too small to see through to the light bulb above, albeit, light from the source will emanate from the notches.

The preferred embodiment is contemplated to have a twelve inch diameter outside dome 14 with a quarter inch flange 16 and a five inch hole 18 in the center of the outer dome 14. The cup 22 is inserted through the hole 18 in the outer dome 14 with the tabs 24 aligned with the notches 28 so the cup 22 passes through the hole 18 in the outer dome 14. The cup 22 is then slightly turned and let go.

To install the cover over any recessed lighting fixture, the user simply performs the following steps:

(1) Remove the liner from the two sided foam tape 20 running around the flange 16 at the perimeter of the outer dome 14;

(2) Align the central circular hole 18 of the outer dome 14 over the whole of the recessed light;

(3) The outer dome 14 is then pressed firmly to the ceiling in the area of the flange 16 holding the two sided tape 20;

(4) The cup 22 is then inserted through the hole 18 in the outer dome 14 and turned slightly to hold the cup 22 in place.

The job is now done in approximately 10 seconds with the recessed light cover permanently attached to the ceiling over the existing recessed down-light. It is important to note that the outer dome 14 and/or the cup 22 may be made of any material or composite. Glass or a plastic polymer or copolymer would be the preferred embodiment. However, the adhesive material 20 employed can place a limit on the weight of the cover. The thickness of the flange 16 running around the perimeter of the outer dome 14 is contemplated to be 0.060" to 0.120" with 0.080" being the preferred thickness. The wall thickness for the outer dome 14 and cup 22 can be thinner. A range of wall thickness in these areas could be 0.020" to 0.060". A wall thickness for the outer dome 14 and cup 22 is preferred to be around 0.250" or less.

A preferred embodiment of the cover is to construct the outer dome 14 and the cup 22 from polycarbonate plastic. The manufacturing processes of injection molding, pressure forming or vacuum forming may be used as well as other processes to form the parts. Polycarbonate is uniquely suited for this use. First, it is almost as clear as glass optically. Second, there are molding grades of polycarbonate resin with processing temperatures over 600F. This is important, to be highly heat resistant, as the part will be used with light bulbs that can generate considerable heat. Lastly, polycarbonate is a very strong material with superior tensile strength characteristics.

When looking at the large light cover of the preferred embodiment mounted to the ceiling, one would think that it was made of glass and weighed five pounds. However, this elegant fixture cover of a full twelve inch diameter weighs only about 2 ounces. Thus, the two sided tape 20 is perfectly adequate to permanently hold the light cover to the ceiling.

It is important to note here the four features of the matched tabs 24 and notches 28:

(1) The tabs 24 and notches 28 allow the cup 22 to be attached to the outer dome 14 without tools;

(2) When the cup 22 is removed from the outer dome 14, the hole 18 has a large enough diameter for one to place their entire hand through the light cover and into the recessed down-light above to easily and quickly change bulbs;

(3) When the cup 22 is attached to the outer dome 14, the notches 28 are no longer filled. In fact, the one-eighth inch notches 28 are now fully exposed to allow convection for heat to escape the light cover;

(4) With the cover attached and the notches 28 exposed, unaltered light will escape the plurality of exposed notches 28, allowing the appearance of bright mini-lights radiating around the perimeter of the cup 22 and providing an added cosmetic lighting feature.

The outer dome 14 and the cup 22 may be molded clear, with textured grain to diffuse light, translucent clear or white and may be plain, with patterns and/or colors printed on or inlaid. One or more Fresnel lenses may be formed on a surface of the cover to direct or spread the light from the light source in the fixture.

Thus, an esthetic and practical cover for a recessed down-light is disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A cover for a recessed down-light fixture, comprising a first lens including an outer dome, a flange lying in a plane extending from a first periphery of the first lens, a central circular hole through the outer dome, the central circular hole having a diameter permitting manual access;

a second lens including an cup having a circular periphery with a diameter of noninterference fit with the central circular hole and an attachment with the first lens.

2. The cover of claim 1, the first lens further including notches about the periphery of the central circular hole, the second lens further including tabs extending radially outwardly from the circular periphery, the tabs being configured and arranged to fit through the notches to form the attachment of the cup to the outer dome.

3. The cover of claim 1 further comprising a ring of adhesive material extending about the flange on the concave side of the outer dome.

4. The cover of claim 3, the adhesive material being double sided adhesive foam tape.

5. The cover of claim 1, the cup having a contour with a peripheral portion upstanding for manual purchase to rotate the cup with the tabs extended through the notches.

6. The cover of claim 1, the tabs being equiangularly spaced about the cup.

7. A cover for a recessed down-light fixture, comprising a first lens including an outer dome, a flange lying in a plane extending from a first periphery of the first lens, a central circular hole through the outer dome having notches about the periphery of the central circular hole;

a second lens including an cup having a circular periphery with a diameter of noninterference fit with the central circular hole and tabs extending radially outwardly from the circular periphery, the tabs being configured and arranged to fit through the notches.

* * * * *